US012403363B1

(12) United States Patent
Keeter

(10) Patent No.: US 12,403,363 B1
(45) Date of Patent: Sep. 2, 2025

(54) GOLF GREEN CHARACTERISTIC INDICATOR

(71) Applicant: Golf IQ, LLC, Denver, CO (US)

(72) Inventor: Tyler H. Keeter, Denver, CO (US)

(73) Assignee: Golf IQ, LLC, Denver, CO (US)

( * ) Notice: Subject to any disclaimer, the term of this patent is extended or adjusted under 35 U.S.C. 154(b) by 0 days.

(21) Appl. No.: 19/032,377

(22) Filed: Jan. 20, 2025

(51) Int. Cl.
*A63B 57/00* (2015.01)
*A63B 71/06* (2006.01)

(52) U.S. Cl.
CPC ..... *A63B 57/00* (2013.01); *A63B 71/0619* (2013.01); *A63B 2071/0694* (2013.01); *A63B 2209/08* (2013.01); *A63B 2220/30* (2013.01)

(58) Field of Classification Search
CPC ..... A63B 57/00; A63B 71/0619; A63B 2071/0694
See application file for complete search history.

(56) References Cited

U.S. PATENT DOCUMENTS

| | | | | |
|---|---|---|---|---|
| 3,215,436 | A | 11/1965 | Carter | |
| 5,788,583 | A | 8/1998 | Agulnek et al. | |
| 6,227,981 | B1 | 5/2001 | Lizama Troncoso et al. | |
| 6,547,680 | B1 | 4/2003 | Marchese, Jr. | |
| 6,860,139 | B2 | 3/2005 | Pelz | |
| 7,225,663 | B2 | 6/2007 | Pelz | |
| 7,306,524 | B1 | 12/2007 | Rogers | |
| 8,277,339 | B2 | 10/2012 | de la Gandara et al. | |
| 9,320,958 | B2 | 4/2016 | Yoo | |
| 10,940,378 | B1 * | 3/2021 | Offerman | A63B 57/40 |
| 2003/0226393 | A1 * | 12/2003 | Pelz | A63B 71/0605 73/9 |
| 2004/0058754 | A1 | 3/2004 | Hughes | |
| 2004/0097303 | A1 * | 5/2004 | Hughes | A63B 57/00 473/404 |
| 2008/0072514 | A1 * | 3/2008 | Barlow | E01C 5/22 52/540 |
| 2009/0100928 | A1 | 4/2009 | Fry et al. | |
| 2010/0285903 | A1 | 11/2010 | Nicodem | |
| 2013/0180314 | A1 | 7/2013 | Quintavalla | |
| 2015/0165286 | A1 | 6/2015 | Brennan et al. | |
| 2015/0182838 | A1 * | 7/2015 | Yoo | A63B 47/008 473/404 |
| 2015/0204777 | A1 | 7/2015 | Quintavalla | |
| 2016/0069791 | A1 | 3/2016 | Lamkin | |
| 2022/0395731 | A1 | 12/2022 | Grant | |
| 2023/0338797 | A1 * | 10/2023 | Krishna Vajjala | A63B 57/10 |
| 2023/0338809 | A1 * | 10/2023 | Facchini | A63B 69/3676 |

FOREIGN PATENT DOCUMENTS

| | | | |
|---|---|---|---|
| KR | 20170125312 | A | 11/2017 |
| KR | 102370170 | B1 | 3/2022 |
| WO | 2023206823 | A1 | 11/2023 |

* cited by examiner

*Primary Examiner* — Eugene L Kim
*Assistant Examiner* — Christopher Glenn
(74) *Attorney, Agent, or Firm* — Stephen B. Katsaros; Patent Engineering, LLC

(57) ABSTRACT

A golf green characteristic indicator is disclosed. The golf green characteristic indicator may include a ground track and an air track configurable between a travel configuration and an indication configuration. In the travel configuration, the ground track and air track may be detached. In the indication configuration, the ground track is fixated on the golf green, while a golf ball is released from a mechanism on the air track to indicate the golf green characteristic.

18 Claims, 9 Drawing Sheets

GOLF GREEN CHARACTERISTIC INDICATOR

TECHNICAL FIELD

This disclosure pertains, but not by way of limitation, to the field of indicating characteristics of golf green. More particularly, the disclosure relates to a golf green characteristics indicator for indicating characteristics of the golf green.

BACKGROUND

Characteristics of the golf green of a golf course, such as golf green speed, are measured using a golf stimpmeter. The golf stimpmeter is a linear ramp configured to be positioned inclined at a predefined angle relative to the golf green, from which a golf ball may be iteratively released to the golf green. The average distance traveled by the golf ball from the golf stimpmeter on the golf green is measured (e.g., in feet) and may be utilized to indicate golf green speed. Conventionally, golf stimpmeters have various characteristics, such as repeatable release of a golf ball, misalignment during measuring the golf speed and difficulty in portability.

SUMMARY

A golf green characteristic indicator is disclosed. The golf green characteristic indicator may include a ground track and an air track. The ground track and the air track may be configured between a travel configuration and an indication configuration. In the travel configuration, the ground track may be detached from the air track; in the indication configuration, the ground track may be attached to the air track. The ground track may be fixated on the golf green, and the golf ball may be released from a golf ball release mechanism disposed on the air track to indicate golf green characteristics, i.e., speed of the golf green. The golf green characteristics indication and an indication method for indicating a characteristic of the golf green are explained in detail in successive configurations of this disclosure.

In an illustrative configuration, a golf green characteristic indicator for indicating a characteristic of a golf ball moving on a golf green is disclosed. The golf green characteristic indicator may include a ground track. The ground track may include a proximal end, a distal end oppositely disposed from the proximal end, a first radius of curvature formed at the distal end of the ground track, and a first coupler disposed at the distal end of the ground track. The golf green characteristic indicator may include an air track. The air track may include a proximal end, a distal end oppositely disposed from the proximal end, and a second radius of curvature at the proximal end of the air track. Further, the second radius of curvature is equal to the first radius of curvature of the ground track. The air track may further include a second coupler disposed at the proximal end of the air track. The golf green characteristic indicator may include an alignment pair disposed in either the first coupler or the second coupler. The alignment pair may include a first alignment feature and a second alignment feature. The golf green characteristic indicator may further include a golf ball release mechanism disposed at the distal end of the air track. The golf green characteristic indicator may include a travel configuration. In the travel configuration, the first coupler of the ground track is detached from the second coupler of the air track. The golf green characteristic indicator may further include an indication configuration. In the indication configuration, the first coupler is interfaced with the second coupler, the first alignment feature is aligned with the second alignment feature, the proximal end of the ground track is configured to adjoin the golf green, and the golf ball release mechanism is configured to release the golf ball sequentially along the air track and the ground track with a predetermined release speed as the golf ball exits the proximal end of the ground track to indicate the characteristic of the golf green.

In an illustrative configuration, a golf green characteristic indication method for indicating a characteristic of a golf ball moving on a golf green is disclosed. The golf green characteristic measurement method may include a first step in which a ground track may be provided. The ground track may include a proximal end, a distal end oppositely disposed from the proximal end, a first radius of curvature formed at the distal end of the ground track, and a first coupler disposed at the distal end of the ground track. In the next step, an air track may be provided. The air track may include a proximal end, a distal end oppositely disposed from the proximal end, and a second radius of curvature at the proximal end of the air track. Further, the second radius of curvature is equal to the first radius of curvature of the ground track. The air track may further include a second coupler disposed at the proximal end of the air track. In the next step, an alignment pair disposed in either the first coupler or the second coupler may be provided. The alignment pair may include a first alignment feature and a second alignment feature. In the next step, a golf ball release mechanism disposed at the distal end of the air track may be provided. In the next step, the ground track and the air track may be configured between a travel configuration and an indication configuration. The travel configuration may include detaching the first coupler of the ground track from the second coupler of the air track. The indication configuration may include interfacing the first coupler with the second coupler, aligning the first alignment feature with the second alignment feature, the proximal end of the ground track is configured to adjoin the golf green, and releasing the golf ball release mechanism. Further, the golf ball release mechanism, on releasing, is configured to release the golf ball sequentially along the air track and the ground track with a predetermined release speed as the golf ball exits the proximal end of the ground track for indicating the characteristic of the golf green.

Further areas of applicability of the present disclosure will become apparent from the detailed description provided hereinafter. It should be understood that the detailed description and specific examples while indicating various configurations, are intended for purposes of illustration only and are not intended to necessarily limit the scope of the disclosure.

BRIEF DESCRIPTION OF THE DRAWINGS

The accompanying figures of the drawing, which are included to provide a further understanding of general aspects of the system/method, are incorporated in and constitute a part of this specification. These illustrative aspects of the system/method, together with the detailed description, explain the principles of the system. No attempt is made to show structural details in more detail than necessary for a fundamental understanding of the system and the various ways it is practiced. The following figures of the drawing include.

In the appended figures, similar components and/or features may have the same reference label. Further, various components of the same type may be distinguished by following the reference label with a dash and a second label that distinguishes among the similar components. If only the first reference label is used in the specification, the description is applicable to any one of the similar components having the same first reference label, irrespective of the second reference label. Where the reference label is used in the specification, the description is applicable to any one of the similar components having the same reference label.

DETAILED DESCRIPTION

Illustrative configurations are described with reference to the accompanying drawings. Wherever convenient, the same reference numbers are used throughout the drawings to refer to the same or like parts. While examples and features of disclosed principles are described herein, modifications, adaptations, and other implementations are possible without departing from the spirit and scope of the disclosed configurations. It is intended that the following detailed description be considered exemplary only, with the true scope and spirit being indicated by the following claims.

Conventional golf stimpmeters can be relatively large and heavy, making them less portable. While smaller, more compact versions may be available, such golf stimpmeters may not always provide the same level of precision as larger models. Moreover, suppose the stimpmeter is not placed in the correct position (e.g., not on a completely flat surface or misaligned with the slope of the green). In that case, inaccurate characteristics or measurements related to green speed may be recorded.

In an effort to make the golf stimpmeter portable and enable accurate measurement of characteristics of the golf green, the present disclosure relates to a golf green characteristic indicator. The golf green characteristic indicator may include a ground track, an air track, and a golf ball release mechanism. The golf ball release mechanism may be configured to release a golf ball, thereby allowing the golf ball to move towards the golf green via the air track and the ground track. The golf green characteristic indicator may be configured in an indication configuration and a traveling configuration. The present disclosure explains the golf green characteristic indicator and configurations in detail, in conjunction with FIGS. 1-10.

Figure 1:
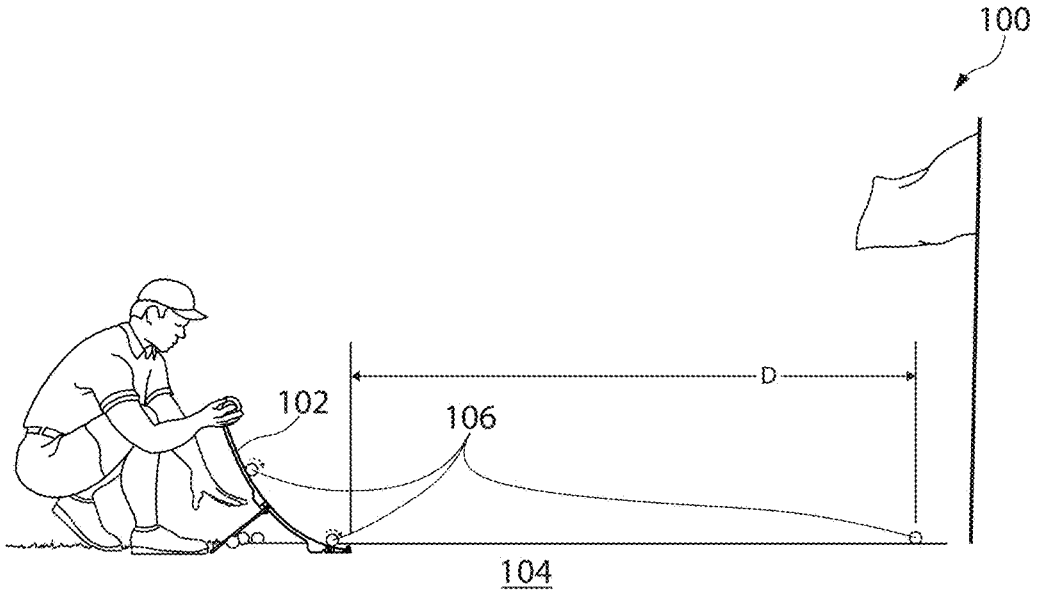
FIG. 1 illustrates a schematic of an individual/person determining a golf green characteristic with a golf green characteristic indicator (in an indication configuration)

FIG. 1 illustrates a schematic 100 of an individual/person determining a golf green characteristic with a golf green characteristic indicator 102 in an indication configuration. In the indication configuration, a user may position the golf green characteristic indicator 102 on the golf green 104. In some configurations, the user may release the golf ball 106 from the golf green characteristic indicator 102 towards the golf green 104. Each golf ball 106, after being dispatched from the golf green characteristic indicator 102, may be configured to travel a predefined distance "D" (ft) on the golf green 104. Such process is iterated to determine one or more values of "D"; hence, the average value of "D" corresponds to the golf green characteristic, i.e., golf green speed of the golf green 104.

Figure 2:
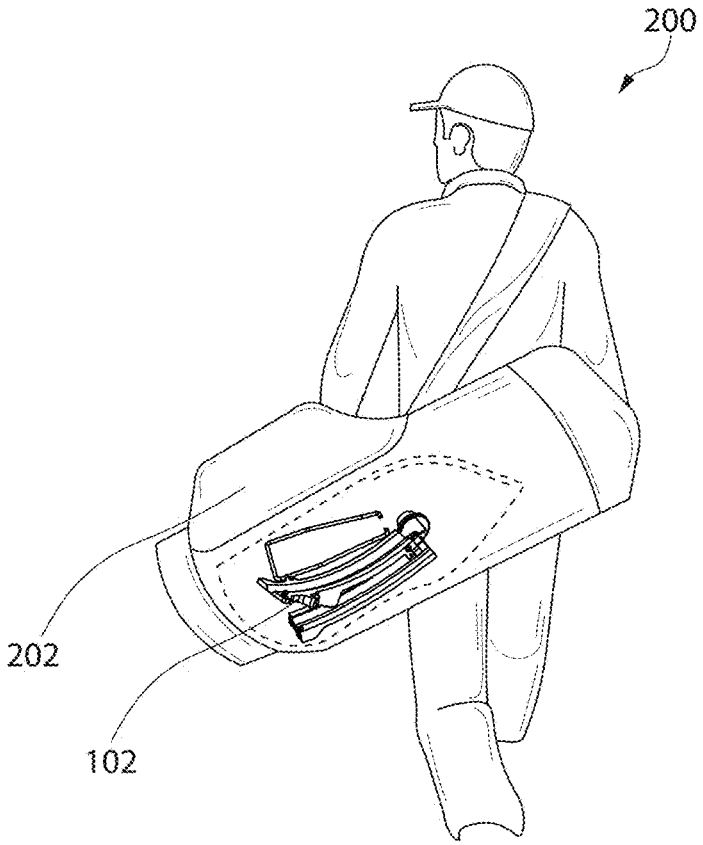
FIG. 2 illustrates a schematic of a golf green characteristic indicator (in a travel configuration)

FIG. 2 illustrates schematic 200 of the individual carrying the golf green characteristic indicator 102 of FIG. 1 in the travel configuration. The golf green characteristic indicator 102, after measuring the golf green characteristic of the golf green 104, may be disassembled and stacked within a travel bag 202. Accordingly, the golf green characteristic indicator 102 may be accommodated within the travel bag 202, providing ease of portability. The golf green characteristic indicator 102 is explained in detail hereinafter.

Figure 3:
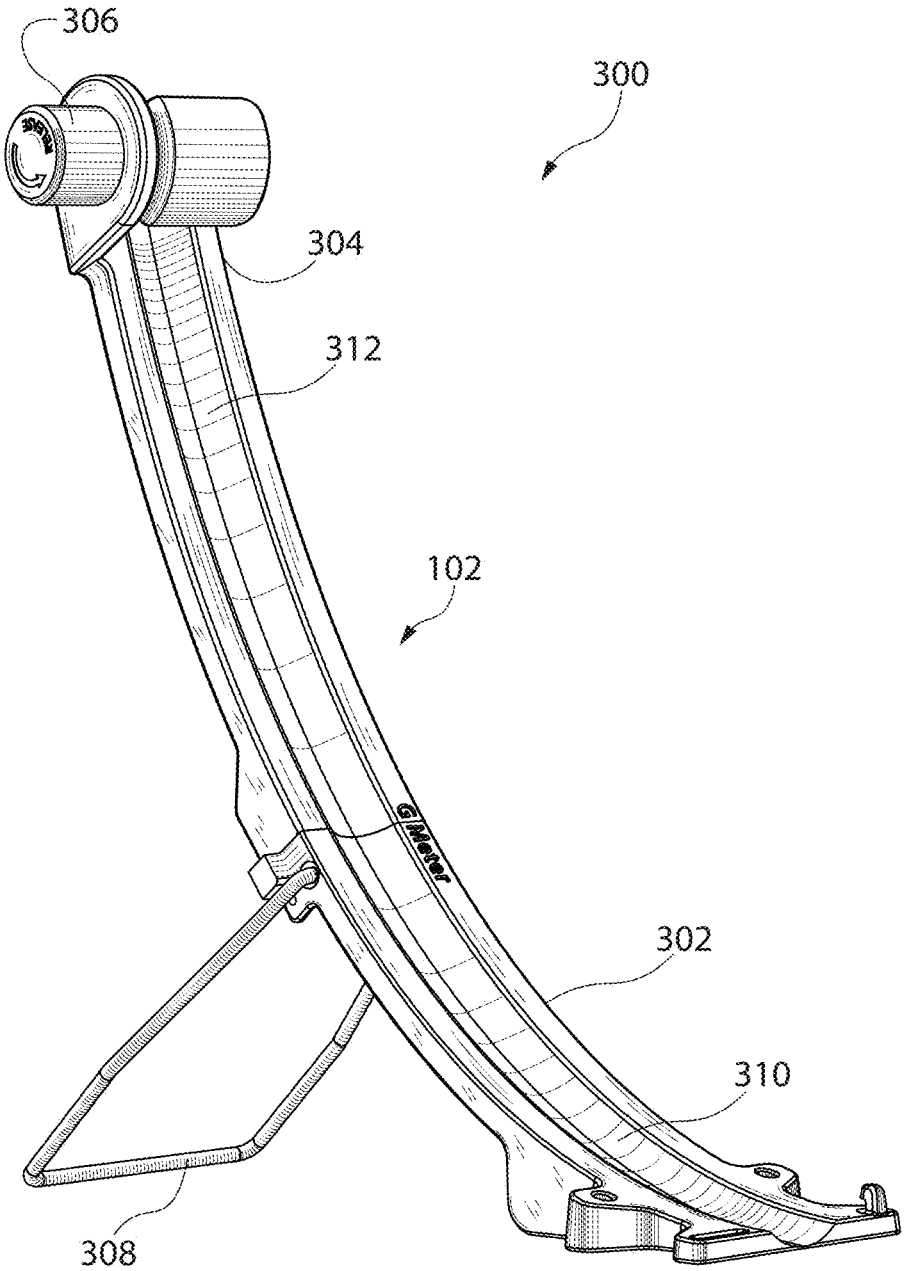
FIG. 3 illustrates a perspective view of a golf green characteristic indicator.

FIG. 3 illustrates a perspective view 300 of a golf green characteristic indicator 102. The golf green characteristic indicator 102 may include a ground track 302 and an air track 304. The golf green characteristic indicator 102 may include a golf ball release mechanism 306 positioned on the air track 304. Further, the ground track 302 may include a ground track guide 310, and the air track 304 may include an air track guide 312. Moreover, in the indication configuration, the golf green characteristic indicator 102, may be mounted on a stand 308 adjoined to the ground track 302.

The ground track 302 may be configured to couple with the air track 304. As such, in some configurations, when the ground track 302 may be coupled to the air track 304, the ground track guide 310 and the air track guide 312 may be aligned to form a continuous track guide. The continuous track guide may be configured to guide the golf ball 106 released from the golf ball release mechanism 306 towards the golf green 104.

Figure 4:
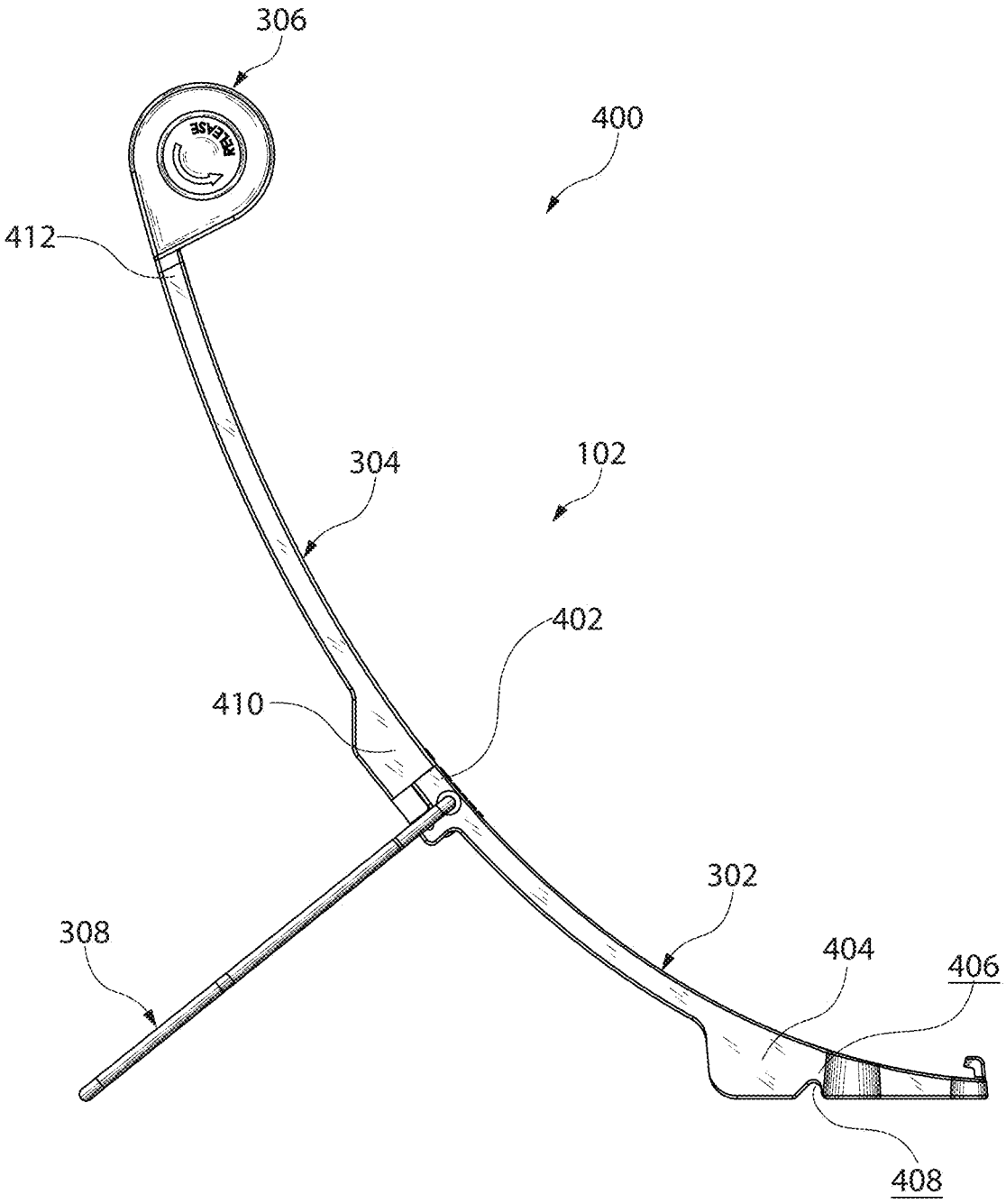
FIG. 4 illustrates a left-side view of a golf green characteristic indicator.

FIG. 4 illustrates a left-side view 400 of a golf green characteristic indicator 102. The ground track 302 may include a ground track distal end 402 and a ground track proximal end 404 disposed oppositely to the ground track distal end 402. The ground track proximal end 404 may be positioned on the golf green 104. Further, the stand 308 may be coupled to the ground track distal end 402. Moreover, the ground track proximal end 404 may include a base 406 and a recess 408. The base 406 may include a planar bottom, which may conform with the surface of the golf green 104. The recess 408 may be formed on the planar bottom of the golf green 104 and may be configured to accommodate the stand 308 in the travel configuration.

The air track 304 may include an air track proximal end 410 and an air track distal end 412. The air track proximal end 410 may be coupled to the ground track distal end 402 to couple the ground track 302 and the air track 304. As such, in some configurations, the ground track 302 and the air track 304 may collectively form a continuous curved profile, such as a parabolic-shaped curve. The parabolic-shaped curve, in addition to the continuous guide track, may ensure seamless and uninterrupted travel of the golf ball 106 from the air track 304 to the golf green 104. The parabolic-shaped curve collectively formed by the ground track 302 and the air track 304 is explained in detail hereinafter.

Figure 5:
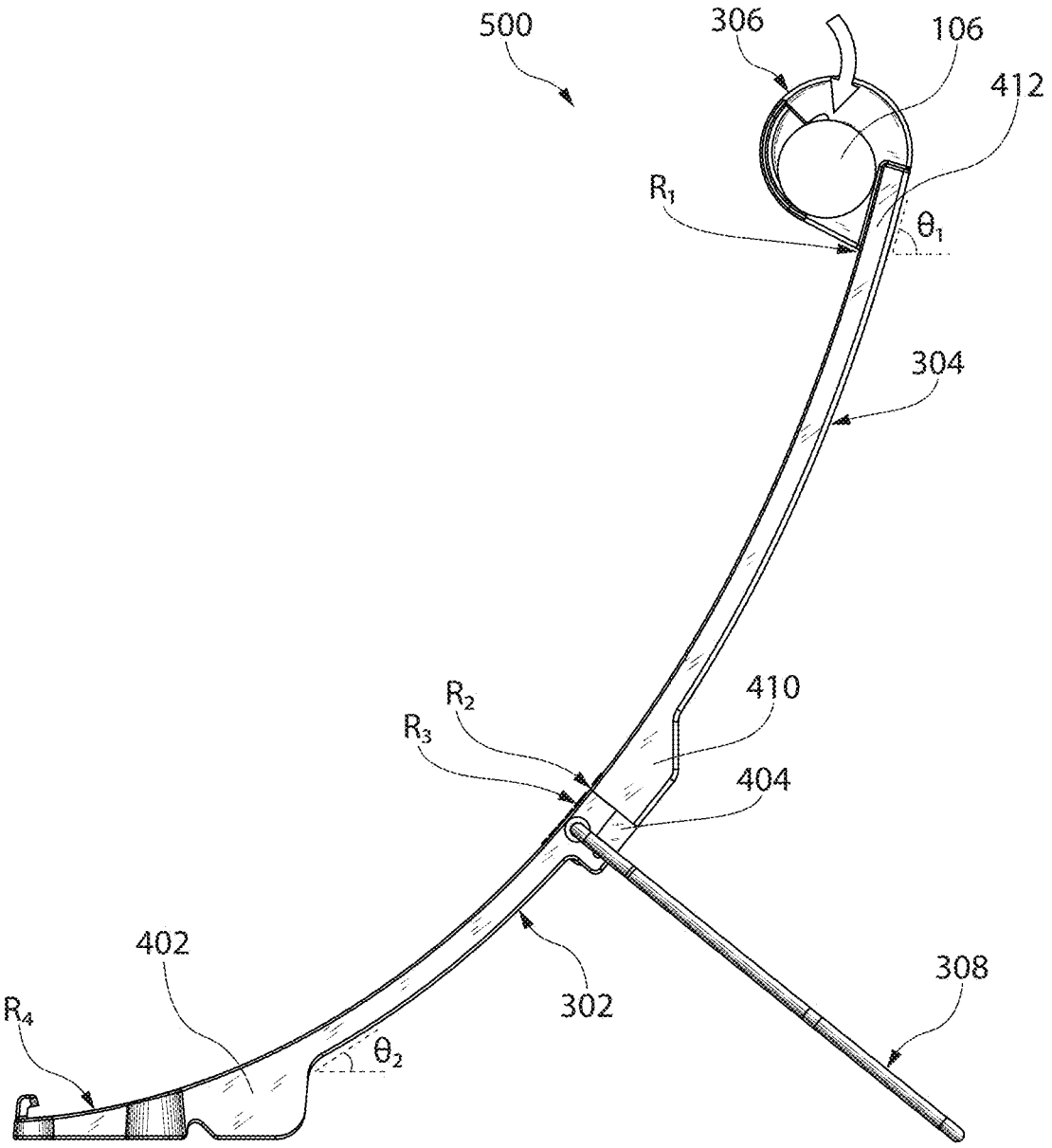
FIG. 5 illustrates a right-side view of a golf green characteristic indicator.

FIG. 5 illustrates a right-side view 500 of a golf green characteristic indicator 102. As explained earlier, the ground track 302 and the air track 304 may collectively form a continuous curved profile to allow seamless and uninterrupted travel of the golf ball 106 from the air track 304 to the golf green 104. The continuous curved profile is defined as a parabolic-shaped curve, with a variable radius of curvature across each point on the ground track 302 and the air track 304. For example, the radius of curvature from an imaginary center "O" may vary across the ground track 302 and the air track 304.

With continued reference to FIG. 5, the radius of curvature at the golf ball release mechanism 306, or the air track distal end 412 is denoted by "$R_1$", the radius of curvature at the air track proximal end 410 is denoted by "$R_2$", the radius of curvature at the ground track distal end 402 is denoted by "$R_3$", and the radius of curvature at the ground track proximal end 404 is denoted by "$R_4$". As seen, the $R_1$, $R_2$, $R_3$, and $R_4$ may be measured from the center "O." As such, in some configurations, the radius of curvatures may increase from the golf ball release mechanism 306 towards the ground track proximal end 404. For example, the magnitude of $R_1$ may be less than the magnitude of $R_2$, and the magnitude of $R_3$ may be less than the magnitude of $R_4$. This increase in the radius of curvature, from $R_1$ to $R_4$ may result in the shaping of the continuous curved profile formed by the ground track 302 and the air track 304 as the parabolic-shaped curve.

To maintain consistency of the curve, the magnitude of $R_2$ may be equal to the magnitude of $R_3$. Put differently, the radius of curvature at the ground track proximal end 404 may be equal to the radius of curvature at the air track proximal end 410. Such configuration may allow the formation of a smooth track or smooth contour of the continuous track guide between the air track distal end 412 and the ground track distal end 402. Thus, the movement of golf ball 106 may be uninterrupted on both the ground track 302 and the air track 304 upon being released by the golf ball release mechanism 306. Advantageously, losses in velocity of the golf ball 106 incurred due to such interruption may be prevented.

With continued reference to FIG. 5, the difference in magnitude of $R_1$ and $R_3$ may result in the air track distal end 412 and the ground track distal end 402 formed at various inclinations. For instance, as a result of $R_1$, the air track distal end 412 may be configured at an inclination $\theta_1$ varying from about 30° to about 40°. Further attributable to $R_4$, the ground track distal end 402 may be configured at an inclination $\theta_2$ ranging from about 20° to about 25°. As such, the inclination $\theta_2$ of the ground track distal end 402 may be equivalent to an exit angle or an angle at which the conventional golf stimpmeters are required to be inclined to release the golf ball 106 to the golf green 104.

With continued reference to FIG. 5, the golf green characteristic indicator 102 may be formed of a height H ranging from about 8 inches to about 10 inches or from about 0.6 ft to about 1 ft. Moreover, the golf green characteristic indicator 102 may be formed of a length L from about 16 inches to about 18 inches, or from about 1.4 ft to about 1.8 ft. Accordingly, with such dimensions and with inclinations $\theta_1$, $\theta_2$, the golf ball 106 may exit at the requisite velocity to measure the characteristics of the golf green 104.

Figure 6:
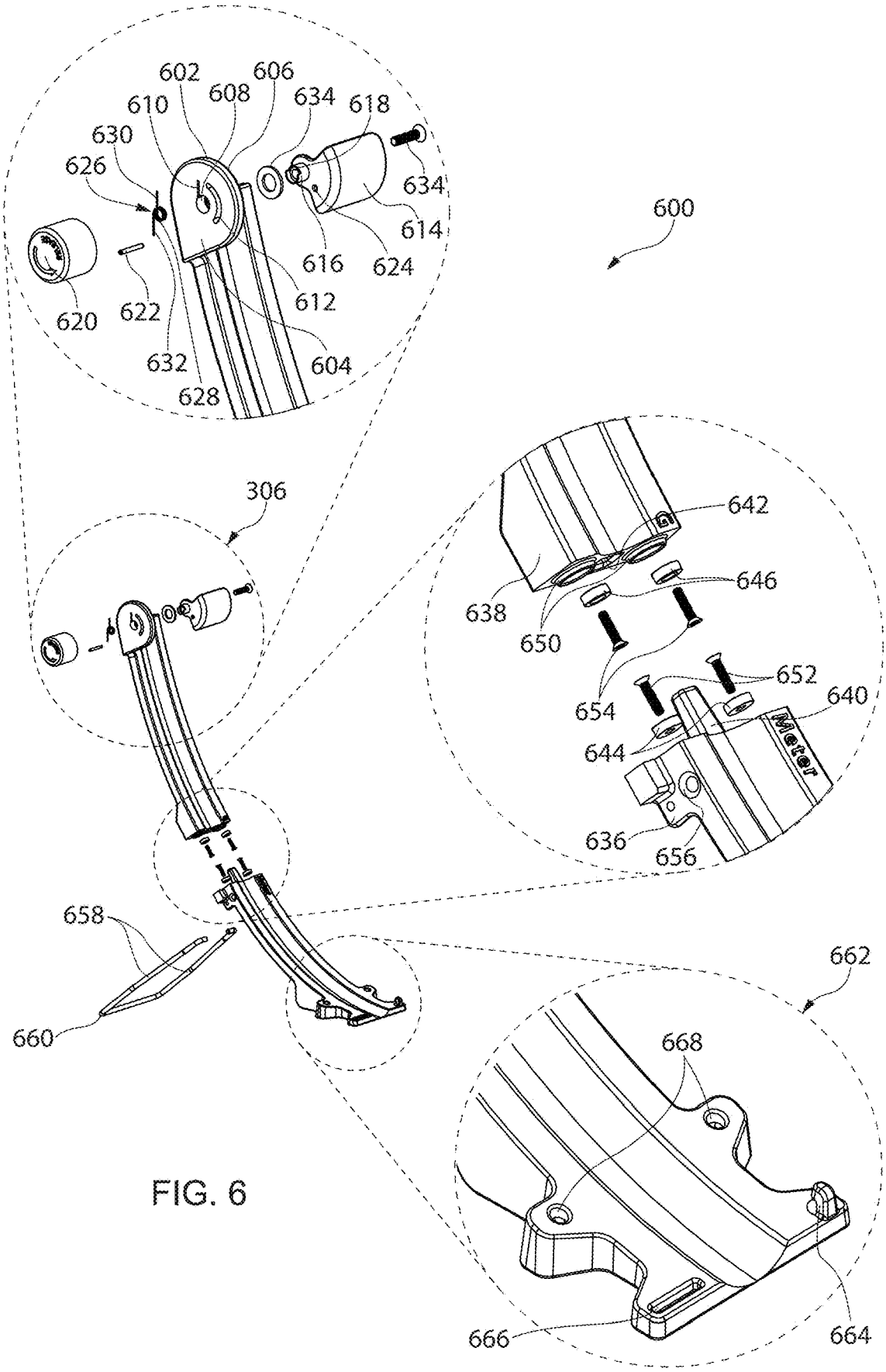
FIG. 6 illustrates an exploded view of the golf green characteristic indicator.

FIG. 6 illustrates an exploded view 600 of the golf green characteristic indicator 102. As explained earlier, the golf green characteristic indicator 102 may include the golf ball release mechanism 306. The golf ball release mechanism 306 may include a support plate 602 adjoined to the air track distal end 412. The support plate 602 may include a left face 604, a right face 606, a central hole 608, a first torsion spring pocket 610, and a radial pocket 612. Further, the golf ball release mechanism 306 may include a golf ball cradle 614. The golf ball cradle 614 may include a central shaft 616. Further, the golf ball cradle 614 may include a second torsion spring pocket 618. The golf ball cradle 614 may be shaped as a hollow cylindrical segment configured to accommodate the golf ball 106 prior to release for measuring characteristics of the golf green 104.

The golf ball release mechanism 306 may further include a knob 620 coupled to the golf ball cradle 614. For example, the knob 620 may be coupled to the golf ball cradle 614 via a pin 622. To further elaborate, the pin 622 may be configured to pass through the radial pocket 612 and engage to a slot 624 formed on the golf ball cradle 614. Simultaneously, the pin may be coupled to the knob 620, thereby coupling the knob 620 to the golf ball cradle 614. In addition, the knob 620 may also be coupled to the central shaft 616. Henceforth, the rotation of knob 620 may simultaneously rotate the golf ball cradle 614 to release the golf ball 106.

The golf ball release mechanism 306 may further include a torsion spring 626 biasingly adjoining the support plate 602 and the golf ball cradle 614. The torsion spring may include a coil 628, a first leg 630, and a second leg 632. The first leg 630 may extend from the coil 628, and the second leg 632 may further extend from the coil 628 in a direction opposite to the first leg 630. Moreover, the first leg 630 may be adjoined to the first torsion spring pocket 610, and the second leg 632 may be coupled to the knob 620. Further, the coil 628 may be disposed in the central hole 608 and coupled to the central hole 608. The coil 628 may be wound about the central shaft 616 and coupled to the second torsion spring pocket 618. The knob 620 may be rotated against a residual torsion force in the torsion spring 626 from an original position in a counterclockwise direction to rotate the golf ball cradle 614. After rotation, the knob 620 may be reinstated to the original position by the residual torsion force in the torsion spring 626.

When assembled, the knob 620 may adjoin the left face 604 of the support plate 602, and the golf ball cradle 614 may adjoin the right face 606 of the support plate 602. Moreover, a friction reduction element 634, such as a bushing ring, may be disposed between the golf ball cradle 614 and the right face 606 of the support plate 602. The friction reduction element 634 may reduce friction between the golf ball cradle 614 and the right face 606 during rotation of the golf ball cradle 614.

With continued reference to FIG. 6, the golf green characteristic indicator 102 may include a first coupler 636 and a second coupler 638. The first coupler 636 may be formed in the ground track distal end 402, and the second coupler 638 may be formed in the air track proximal end 410. The first coupler 636 may be coupled to the second coupler 638 to align and couple the ground track 302 and the air track 304. To further elaborate, each of the first coupler 636 and the second coupler 638 may include an alignment pair and a magnet pair configured to align and couple the ground track distal end 402 with the air track proximal end 410 in the indication configuration.

The alignment pair may include a first alignment feature 640 and a second alignment feature 642. The first alignment feature 640 may be formed in the first coupler 636, and the second alignment feature 642 may be formed in the second coupler 638. Further, the first alignment feature 640 may be slidingly engaged with the second alignment feature 642 to align the first coupler 636 and the second coupler 638 in the indication condition. In some configurations, the first alignment feature 640 may be designed in conformity with the second alignment feature 642 to ensure a proper alignment of the first coupler 636 and the second coupler 638, thereby aligning the ground track 302 with the air track 304. In an illustrative configuration, any one of the first alignment feature 640 or the second alignment feature 642 may include a tapered protrusion, and either of the first alignment feature 640 or the second alignment feature 642 may include a tapered pocket. For example, if the first alignment feature 640 may be formed as a tapered protrusion, the second alignment feature 642 may be formed as a tapered pocket, and vice versa.

Accordingly, the interfacing of the first alignment feature 640 with the second alignment feature 642 may result in the accommodation of the tapered protrusion within the tapered pocket. Due to the tapered shape of the tapered protrusion and the tapered shape of the tapered pocket in conformity with the tapered protrusion, the first coupler 636 may be aligned, and locked with the second coupler 638. Such alignment prevents rotation or movement of the first coupler 636 relative to the second coupler 638, thereby preventing the rotation of the ground track 302 relative to the air track 304.

With continued reference to FIG. 6, the alignment and coupling of the first alignment feature 640 with the second alignment feature 642 may be reinforced with the magnetic pair. In addition to the alignment features, the magnetic pair may be disposed within the first coupler 636 and the second coupler 638. The magnetic pair may include a first magnet 644 of a first magnetic polarity and a second magnet 646 of a second magnetic polarity. The second polarity may be opposite to the first polarity. Alternatively, the second magnet 646 may be replaced by a ferromagnetic ring, which may be configured to be attracted to the first magnet 644. The first magnet 644 may be disposed in either the first coupler 636 or the second coupler 638, and the second magnet 646 may be disposed in either the first coupler 636 or the second coupler 638.

Particularly, the first magnet 644 may be disposed in a first pair of magnet pockets 648 formed in either of the first coupler 636 or the second coupler 638. Similarly, the second magnet 646 may be disposed in a second pair of magnet pockets 650 formed in either the first coupler 636 or the second coupler 638. As seen in FIG. 6, the first magnet 644 may be disposed and affixed within a first pair of magnet pockets 648 (not shown in the figure) formed in the first coupler 636 using magnet fasteners 652. Moreover, the second magnet 646 may be disposed in a second pair of magnet pockets 650 formed in the second coupler 638 using magnet fasteners 654.

As may be appreciated, the first magnet 644 may attract the second magnet 646 and form a magnetic coupling. Accordingly, the magnetic coupling may be configured to couple the first coupler 636 and the second coupler 638, in addition to the alignment implemented using the first alignment feature with the second alignment feature. Accordingly, with the coupling of the first coupler 636 with the second coupler 638 using the magnetic pair and the alignment pair, the ground track 302 may be coupled to the air track 304 with a proper consistency of the continuous curved profile.

With continued reference to FIG. 6, the second coupler 638 may include a plurality of stand pockets 656. The plurality of stand pockets 656 may be coupled to the stand 308. Particularly, the stand 308 may include a pair of legs 658 rotatably coupled to the plurality of stand pockets 656. Moreover, the stand 308 may include a web 660 formed between the pair of legs 658. The web 660 may be coupled to the recess 408 in the travel configuration.

The plurality of stand pockets 656 may be configured to constrain rotation of the pair of legs 658 up to a predefined angle relative to the golf green 104. In the indication configuration, the stand 308 or the web 660 may be rotationally decoupled from the recess 408 and may be rotated by a predefined inclination angle relative to the ground track distal end 402 or the second coupler 638. Hence, the stand 308 may be adjoined to the golf green 104 at a predefined inclination angle to align the ground track proximal end 404 with the golf green 104 and provide an appropriate elevation to the air track distal end 412. After measuring the golf green characteristics in the travel configuration, the stand 308 may be rotatably coupled to the recess 408.

The ground track proximal end 404 may include a predetermined list of features 662. The predetermined list of features 662 may include a hook 664, a transverse slot 666, and a plurality of golf tee slots 668. The predetermined list of features 662 may enable a proper alignment of the ground track proximal end 404 with the golf green 104 and enable a proper measurement of the characteristics of the golf green 104. For example, the plurality of golf tee slots 668 may enable passage of the plurality of golf tee (refer to a plurality of golf tees 802 in FIG. 8) through or put differently, the golf tee is inserted in the plurality of golf tee slots 668 as the ground track distal end 402 may be positioned on the golf green 104. As such, the plurality of the golf tee may be configured to nail the ground track distal end 402 on the golf green 104, thereby preventing misalignment of the golf green characteristic indicator 102 while measuring characteristics of the golf green 104. Moreover, the transverse slot 666 may be configured to receive an end hook of a tape measure or a measuring tape. Similarly, the hook 664 may be configured to engage with a loop of a ruler. As may be appreciated, the tape measure or the ruler may be utilized to measure the distance traveled by the golf ball 106 after exiting the ground track 302.

Figure 7:
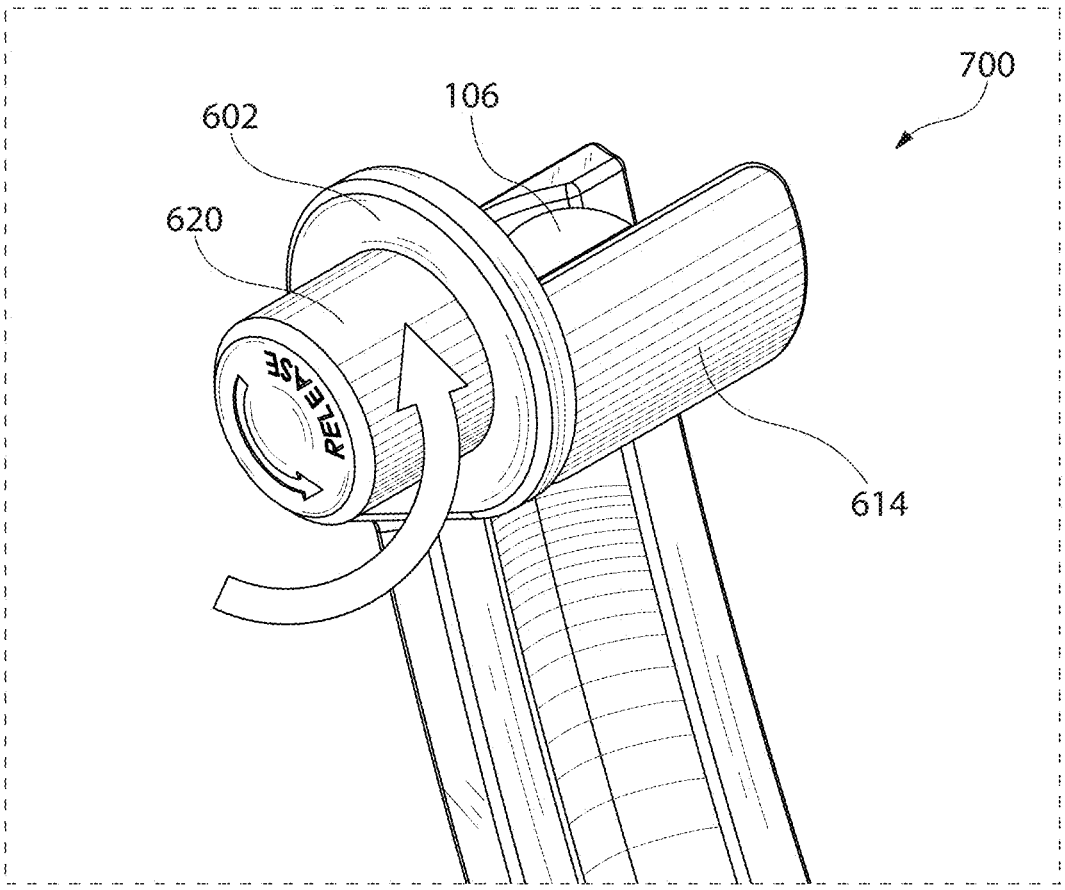
FIG. 7 illustrates a perspective view of the golf ball release mechanism.

FIG. 7 illustrates a perspective view 700 of the golf ball release mechanism 306. In the indication configuration, the golf ball release mechanism 306, as explained earlier, may be configured to release the golf ball 106 from the air track distal end 412. Particularly, the golf ball cradle 614 may be configured to accommodate the golf ball 106. As explained earlier, the golf ball cradle 614 may be formed as a hollow cylindrical segment. The hollow cylindrical segment may be formed of a predefined radius measured from the central shaft 616 and a length similar to the width of the air track distal end 412.

The hollow cylindrical segment may be configured to accommodate the golf ball 106. When the golf ball cradle 614 may be rotated using the knob 620, the hollow cylindrical segment may rotate in a circular trajectory similar to a circumference of an imaginary cylinder formed of a radius similar to the radius of the hollow cylindrical segment. Accordingly, the golf ball 106 may be dropped on the air track distal end 412. Subsequently, the golf ball 106 may travel along the air track 304 and the ground track 302.

Figure 8:
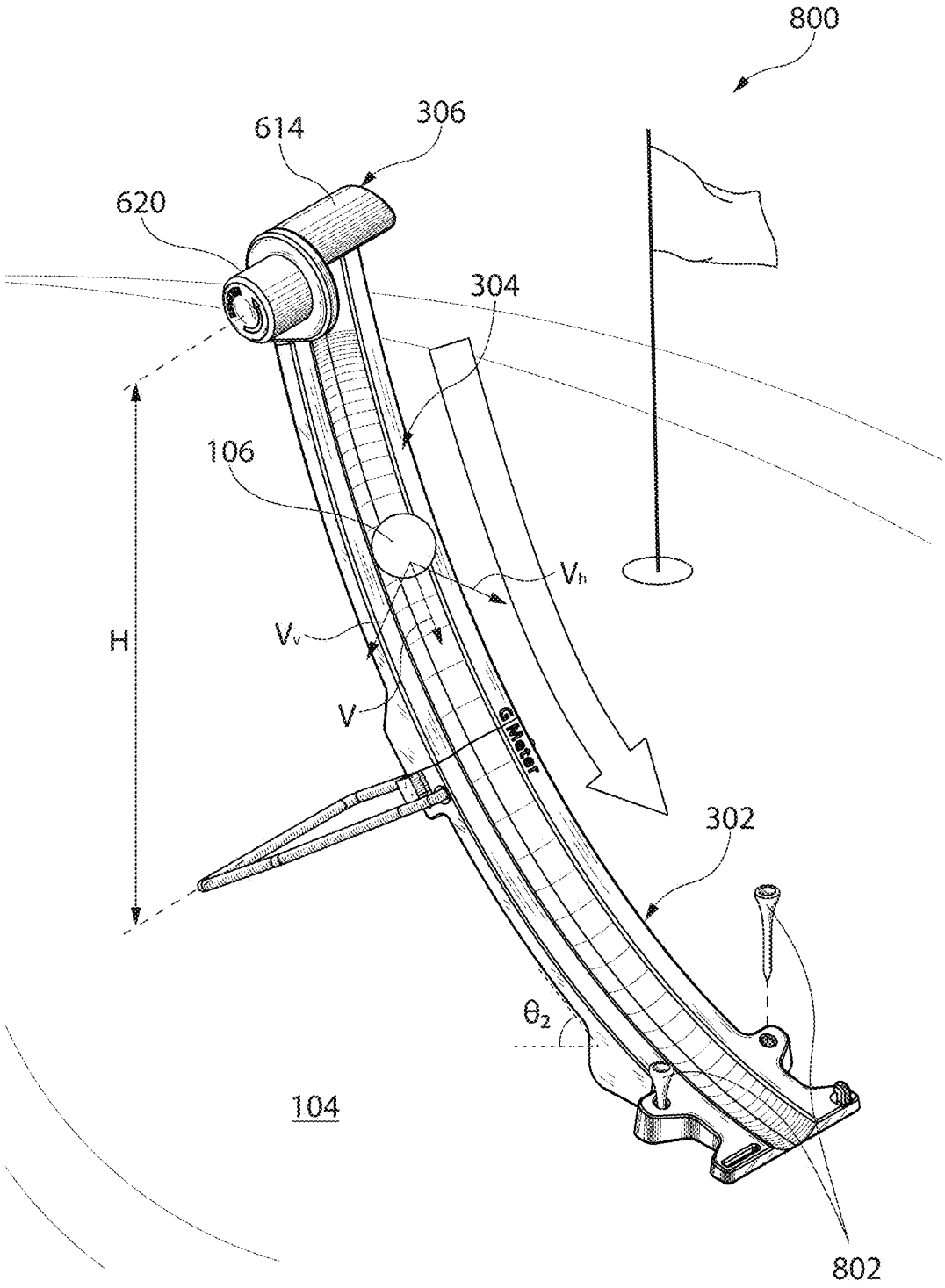
FIG. 8 illustrates a schematic illustratively depicting the golf ball traveling through the air track and the ground track.

FIG. 8 illustrates a schematic 800 illustratively depicting the golf ball 106 traveling through the air track 304 and the ground track 302. Initially, in the indication configuration, the first coupler 636 may be interfaced with the second coupler 638, and the first alignment feature 640 may be aligned with the second alignment feature 642 to couple the ground track 302 and the air track 304. Further, the ground track proximal end 404 may be configured to adjoin the golf green 104. Moreover, the ground track proximal end 404 may be aligned and nailed in the golf green 104 using a plurality of golf tees 802. Further, the golf ball release mechanism 306 may be configured to release the golf ball 106 sequentially along the ground track 302 and the air track 304.

The golf ball 106 may be configured to travel along ground track 302 and air track 304 at a predetermined speed. The predetermined speed may depend on an angle of inclination and an elevation at which the golf ball 106 may be released, or the elevation of the air track distal end 412. The predetermined speed is calculated using an energy conversion equation:

$$mgH=\tfrac{1}{2}mv_h^2 \quad (1)$$

where, m=mass of the golf ball;

$$g = \text{acceleration due to gravity } 9.81\left(\frac{\text{m}}{\text{s}^2}\right) \text{ or } 32.2\left(\frac{\text{ft}}{\text{s}^2}\right);$$

H=elevation of the air track distal end 412 relative to the golf green 104; and $v_h=v\cos\theta_2$, a predetermined release speed of the golf ball 106.

where, $\theta_2$=an inclination angle of the golf green characteristic indicator 102, or angle of inclination of the ground track proximal end 404 relative to the golf green 104.

In an exemplary configuration, the mass (m) of the golf ball 106 may be about 46 grams, and the elevation (H) of about 1 ft, and with the angle of inclination $\theta_2$ of the ground track proximal end 404 relative to the golf green 104 ranging about 20°. With equation (1), the predetermined release speed of the golf ball 106 may be obtained from about 6 ft/second to about 8 ft/second. Such speed of the golf ball 106 may be the requisite speed to exit the ground track 302 and allow travel of the golf ball 106 along the golf green 104.

Figure 9:
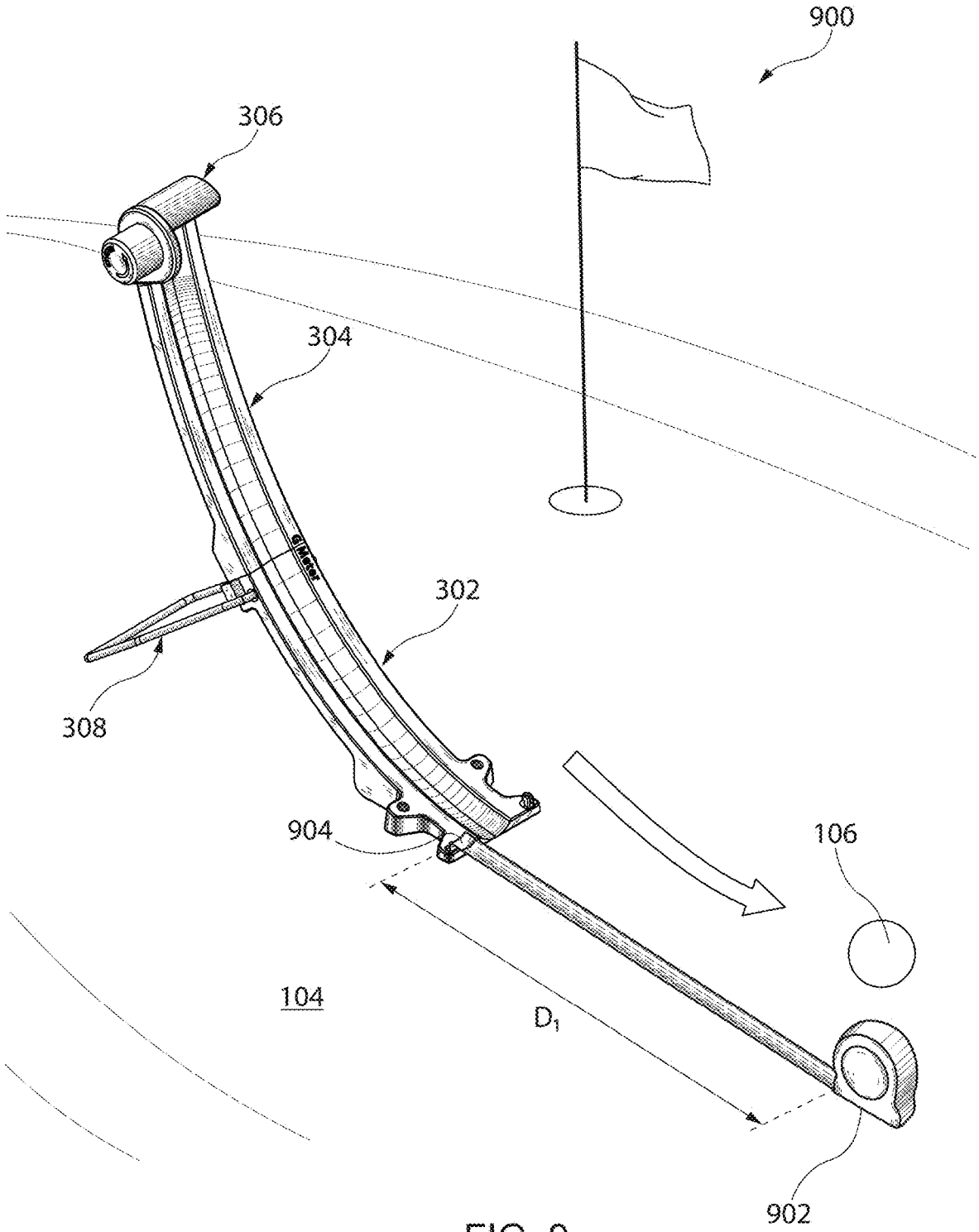
FIG. 9 illustrates a schematic illustratively depicting the golf ball traveling through the golf green.

FIG. 9 illustrates a schematic 900 illustratively depicting the golf ball 106 traveling through the golf green 104. The travel of the golf ball 106 along the golf green 104 may be measured using a tape measure 902 or a ruler (not shown). For instance, a hook 904 of the tape measure 902 may be received by the transverse slot 666, and the tape may be extended to a point at which the motion of the golf ball 106 may be ceased. Accordingly, the distance from the ground track proximal end 404 and the point at which the golf ball 106 may be stopped may be calculated as D (in feet). The distance D may be iteratively measured, and an average of the magnitude of D may be referred to as a characteristic of the golf green 104, or in other words, the speed of the golf green 104.

Figure 10:
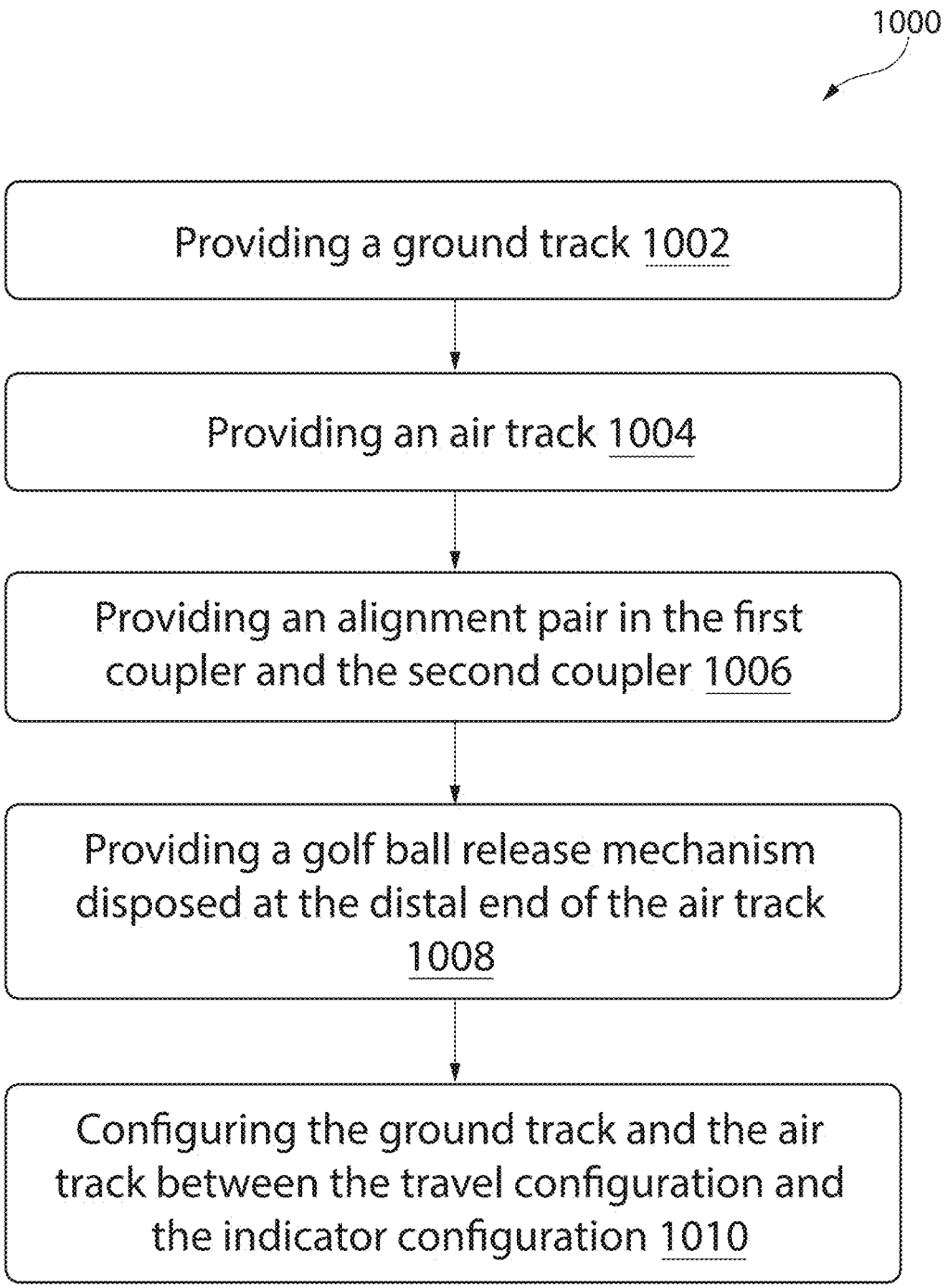
FIG. 10 illustrates a flowchart of a golf green characteristic indication method for indicating a characteristic of a golf green.

FIG. 10 illustrates a flowchart 1000 of a golf green characteristic indication method for indicating a characteristic of a golf green 104. The golf green characteristic method may include a plurality of steps to be implemented to assemble the golf green characteristic indicator 102 and determine the characteristic of the golf green 104, or in other words, determine the speed of the golf green 104. The steps of the golf green characteristic method are explained hereinafter.

At step 1002, a ground track 302 may be provided. The ground track 302 may include ground track distal end 402 and a ground track proximal end 404 oppositely disposed to the ground track distal end 402. Further, the ground track distal end 402 may be formed at a radius of curvature $R_2$. Moreover, the ground track 302 may include a first coupler 636 disposed at the ground track distal end 402.

At step 1004, an air track 304 may be provided. The air track 304 may include an air track proximal end 410 and an air track distal end 412 oppositely formed at the air track proximal end 410. Further, the air track proximal end 410 may be formed at a radius of curvature $R_1$. Moreover, the air track 304 may include a second coupler 638 disposed at the air track proximal end 410. As such, in some configurations, the radius of curvature $R_1$ may be equal to the radius of curvature $R_2$.

At step 1006, an alignment pair may be provided. The alignment pair may include a first alignment feature 640 and a second alignment feature 642. The first alignment feature 640 may be formed in the first coupler 636, and the second alignment feature 642 may be formed in the second coupler 638. The first alignment feature 640 may be slidingly engaged with the second alignment feature 642 to align the first coupler 636 and the second coupler 638.

At step 1008, a golf ball release mechanism 306 may be provided. Particularly, the golf ball release mechanism 306 may be adjoined to the air track distal end 412. Further, the golf ball release mechanism 306 may include a support plate 602 adjoined to the air track distal end 412. The support plate 602 may include a left face 604, a right face 606, a central hole 608, a first torsion spring pocket 610, and a radial pocket 612. Further, the golf ball release mechanism 306 may include a golf ball cradle 614. The golf ball cradle 614 may include a central shaft 616. Further, the golf ball cradle 614 may include a second torsion spring pocket 618. The golf ball cradle 614 may be shaped as a hollow cylindrical segment configured to accommodate the golf ball 106 prior to release for measuring characteristics of the golf green 104. Further, the golf ball release mechanism 306 may include a knob 620. The knob 620 may also be coupled to the central shaft 616. As such, the rotation of knob 620 may simultaneously rotate the golf ball cradle 614 to release the golf ball 106.

At step 1010, the golf green characteristic indicator 102, particularly the ground track 302 and the air track 304 may be configured between a travel configuration and an indication configuration. In the indication configuration, the first coupler 636 may be interfaced with the second coupler 638, and the first alignment feature 640 may be aligned with the second alignment feature 642 to couple the ground track 302 and the air track 304. The ground track 302 and the air track 304 may collectively form a continuous curved profile. Further, the ground track proximal end 404 may be configured to adjoin and nailed in the golf green 104 using a plurality of golf tees 802. Further, the golf ball release mechanism 306 may be actuated to release the golf ball 106 sequentially along the ground track 302 and the air track 304 to indicate or measure the characteristic of the golf green 104. After the indication of the golf green 104, the golf green characteristic indicator 102 may be configured in the travel configuration. In the travel configuration, the first coupler 636 may be detached from the second coupler 638, separating the ground track 302 and the air track 304.

The methods, systems, devices, graphs, and/or tables are illustrative examples, and configurations may omit, substitute, or add various procedures or components as appropriate. For instance, the methods may be reordered in alternative configurations, and/or various stages may be added, omitted, and/or combined. Alternatively, features described with respect to certain configurations may be in various alternative configurations. Different aspects and elements of the configurations may be combined similarly. Also, technology evolves; thus, many of the elements are examples and do not limit the scope of the disclosure or claims.

Additionally, the techniques discussed herein may provide differing results with different types of context awareness classifiers.

Unless defined otherwise, all technical and scientific terms used herein have the same meaning as commonly or conventionally understood. As used herein, the articles "a" and "an" refer to one or more than one (i.e., to at least one) of the grammatical object of the article. By way of example, "an element" means one element or more than one element. "About" and/or "approximately" as used herein when referring to a measurable value such as an amount, a temporal duration, and the like encompass variations of ±20% or ±10%, ±5%, or ±0.1% from the specified value as such variations are appropriate in the context of the systems, devices, circuits, methods, and other implementations described herein. "Substantially," as used herein when referring to a measurable value such as an amount, a temporal duration, a physical attribute (such as frequency), and the like, also encompasses variations of ±20% or ±10%, ±5%, or ±0.1% from the specified value as such variations are appropriate in the context of the systems, devices, circuits, methods, and other implementations described herein.

As used herein, including in the claims, "and" as used in a list of items prefaced by "at least one of" or "one or more of" indicates that any combination of the listed items may be utilized. For example, a list of "at least one of A, B, and C" includes any of the combinations A, B, C, AB, AC, BC, and/or ABC (i.e., A, B, and C). Furthermore, to the extent more than one occurrence or use of the items A, B, or C is possible, multiple uses of A, B, and/or C may form part of the contemplated combinations. For example, a list of "at least one of A, B, and C" may include AA, AAB, AAA, BB, etc.

While illustrative and presently preferred embodiments of the disclosed systems, methods, and/or machine-readable media have been described in detail herein, it is to be understood that the inventive concepts may be otherwise variously embodied and employed and that the appended claims are intended to be construed to include such variations except as limited by the prior art. While the principles of the disclosure have been provided in connection with specific apparatuses and methods, it is to be clearly understood that this description is made only by way of example and not as a limitation on the scope of the disclosure.

What is claimed is:

1. A golf green characteristic indicator for indicating a characteristic of a golf green, the golf green characteristic indicator comprising: a ground track comprising: a proximal end; a distal end oppositely disposed from the proximal end; a first radius of curvature formed at the distal end of the ground track; and a first coupler disposed at the distal end of the ground track; an air track comprising: a proximal end; a distal end oppositely disposed from the proximal end; a second radius of curvature at the proximal end of the air track, wherein the second radius of curvature is equal to the first radius of curvature of the ground track; and a second coupler disposed at the proximal end of the air track; an alignment pair disposed in either the first coupler or the second coupler, the alignment pair comprising: a first alignment feature; and a second alignment feature; a golf ball release mechanism disposed at the distal end of the air track, the golf ball release mechanism comprising: a support plate adjoined to the distal end of the air track, comprising: a left face; a right face; a central hole; a first torsion spring pocket; and a radial pocket; a golf ball cradle comprising: a central shaft passing through the central hole; a second torsion spring pocket; and a pin adjoining the radial pocket; a knob formed about the central shaft; and a torsion spring biasingly adjoining the support plate and the golf ball cradle; wherein the left face of the support plate adjoining the knob and the right face of the support plate is adjoining the golf ball cradle; a travel configuration wherein: the first coupler of the ground track is detached from the second coupler of the air track; and an indication configuration wherein: the first coupler is interfaced with the second coupler; the first alignment feature is aligned with the second alignment feature; the proximal end of the ground track is configured to adjoin the golf green; and the golf ball release mechanism is actuated to release a golf ball sequentially along the air track and the ground track with a predetermined release speed as the golf ball exits the proximal end of the ground track to indicate the characteristic of the golf green.

2. The golf green characteristic indicator of claim 1, wherein either of the first alignment feature or the second alignment feature comprises:

a tapered protrusion.

3. The golf green characteristic indicator of claim 2, wherein either of the first alignment feature or the second alignment feature comprises:

a tapered pocket;

wherein in the indication configuration the tapered protrusion is slidingly engaged with the tapered pocket.

4. The golf green characteristic indicator of claim 1 and further comprising:

a first magnet disposed in either the first coupler or the second coupler.

5. The golf green characteristic indicator of claim 4 and further comprising, in either of the first coupler or the second coupler any one of:

a second magnet, or a ferromagnetic ring oppositely formed to the first magnet.

6. The golf green characteristic indicator of claim 1 and further comprising:

at least one of a predetermined list of features formed in the proximal end of the ground track, the predetermined list of features comprising:

a hook configured to receive a loop of a ruler;

a transverse slot configured to receive an end hook of a tape measure; and a plurality of golf tee slots.

7. The golf green characteristic indicator of claim 1 and further comprising:

a stand, comprising:

a pair of legs;

a web coupled to each of the pair of legs, wherein each of the pair of legs is rotationally coupled to the ground track; and wherein in the travel configuration the web is adjoining the ground track;

wherein in the indication configuration the web is rotationally decoupled from the ground track by a predefined angle relative to the proximal end of the ground track.

8. The golf green characteristic indicator of claim 7 and further comprising:

a recess formed in the ground track at the proximal end to accommodate the web in the travel configuration.

9. The golf green characteristic indicator of claim 1 and further comprising:

a continuous curved profile continuously formed in both the ground track and the air track.

10. A golf green characteristic indication method for indicating a characteristic of a golf green, the golf green characteristic indication method comprising: providing a ground track, the ground track comprising: a proximal end; distal end oppositely disposed from the proximal end; a first radius of curvature formed at the distal end of the ground track; and a first coupler disposed at the distal end of the ground track; providing an air track, the air track comprising: a proximal end; distal end oppositely disposed from the proximal end; a second radius of curvature at the proximal end of the air track, wherein the second radius of curvature is equal to the first radius of curvature of the ground track; and a second coupler disposed at the proximal end of the air track; providing an alignment pair in the first coupler and the second coupler, the alignment pair comprising: a first alignment feature; and a second alignment feature; providing a golf ball release mechanism disposed at the distal end of the air track, the golf ball release mechanism comprising: a support plate adjoined to the distal end of the air track, comprising: a left face; a right face: a central hole; a first torsion spring pocket; and a radial pocket; a golf ball cradle comprising: a central shaft passing through the central hole; a second torsion spring pocket; and a pin adjoining the radial pocket; a knob formed about the central shaft; and a torsion spring biasingly adjoining the support plate and the golf ball cradle; wherein the left face of the support plate adjoining the knob and the right face of the support plate is adjoining the golf ball cradle; and configuring the ground track and the air track between: a travel configuration, comprising: detaching the first coupler of the ground track from the second coupler of the air track; and an indication configuration, comprising: interfacing the first coupler with the second coupler; aligning the first alignment feature with the second alignment feature; the proximal end of the ground track is configured to adjoin the golf green; and actuating the golf ball release mechanism for releasing a golf ball sequentially along the air track and the ground track with a predetermined release speed as the golf ball exits the proximal end of the ground track for indicating the characteristic of the golf green.

11. The golf green characteristic indication method of claim 10, wherein providing the alignment pair further comprises:

either of the first alignment feature or the second alignment feature comprising:

a tapered protrusion.

12. The golf green characteristic indication method of claim 11, wherein providing the alignment pair further comprises:

either of the first alignment feature or the second alignment feature comprising:

a tapered pocket;

wherein in the indication configuration the tapered protrusion is slidingly engaged with the tapered pocket.

13. The golf green characteristic indication method of claim 10 and further comprising:

providing a first magnet, wherein the first magnet disposed in either the first coupler or the second coupler.

14. The golf green characteristic indication method of claim 13 and further comprising:

providing, in either of the first coupler or the second coupler any one of:

a second magnet, or a ferromagnetic ring oppositely formed to the first magnet.

15. The golf green characteristic indication method of claim 10 and further comprising:

providing at least one of a predetermined list of features in the proximal end of the ground track, the predetermined list of features comprising:

a hook configured to receive a loop of a ruler;

a transverse slot configured to receive an end hook of a tape measure; and a plurality of golf tee slots.

16. The golf green characteristic indication method of claim 10 and further comprising:

providing a stand, comprising:

a pair of legs; and a web coupled to each of the pair of legs, wherein each of the pair of legs is rotationally coupled to the ground track;

wherein in the travel configuration, the web is adjoining the ground track;

wherein in the indication configuration, the web is rotationally decoupled from the ground track by a predefined angle relative to the proximal end of the ground track.

17. The golf green characteristic indication method of claim 16 and further comprising:

providing a recess in the ground track at the proximal end to accommodate the web in the travel configuration.

18. The golf green characteristic indication method of claim 10 and further comprising:

providing a continuous curved profile, wherein the continuous curved profile continuously formed in both the ground track and the air track.

* * * * *